US005553411A

United States Patent [19]

Kolton et al.

[11] Patent Number: 5,553,411

[45] Date of Patent: Sep. 10, 1996

[54] BELT MARKETING INDICATOR

[75] Inventors: Chester Kolton, Westfield; Stuart S. Spater, Livingston, both of N.J.

[73] Assignee: B&G Plastics, Inc., Newark, N.J.

[21] Appl. No.: 240,331

[22] Filed: May 10, 1994

Related U.S. Application Data

[63] Continuation-in-part of Ser. No. 960,941, Oct. 14, 1992, Pat. No. 5,339,552, which is a continuation-in-part of Ser. No. 817,750, Jan. 7, 1992, Pat. No. 5,334,274.

[51] Int. Cl.[6] ..... G09F 23/00

[52] U.S. Cl. ..... 40/640

[58] Field of Search ..... 40/299, 640, 641, 40/636, 638, 594, 373–376, 371, 380

[56] References Cited

U.S. PATENT DOCUMENTS

| | | | |
|---|---|---|---|
| 834,294 | 10/1906 | Gremple | 40/380 |
| 1,174,299 | 3/1916 | Taylor | 40/641 X |
| 1,345,782 | 7/1920 | Keller | 40/299 |
| 2,756,525 | 7/1956 | Greenberger | 40/299 X |
| 3,833,452 | 9/1974 | Boucris . | |
| 4,428,134 | 1/1984 | Arnold et al. | 40/299 |
| 4,713,901 | 12/1987 | Wells et al. | 40/404 X |
| 4,756,106 | 7/1988 | Foster | 40/594 X |
| 4,862,617 | 9/1989 | Cooke, Jr. et al. | 40/299 X |
| 4,905,392 | 3/1990 | Klein | 40/638 |
| 5,123,189 | 6/1992 | Fast et al. | 40/299 |

FOREIGN PATENT DOCUMENTS

| | | | |
|---|---|---|---|
| 450108 | 7/1948 | Canada | 40/299 |
| 348043 | 9/1960 | Switzerland | 40/299 |

*Primary Examiner*—Milton Nelson, Jr.
*Attorney, Agent, or Firm*—Robin, Blecker, Daley & Driscoll

[57] ABSTRACT

A method for use in making marketing indicators, each of a predetermined first width, comprises the steps of providing a substrate widthwise of a dimension which is at least a multiple of the predetermined first width and having opposed first and second ends, applying a support member to the substrate widthwise thereof at the first substrate end, making first cuts through the first substrate end at intervals of the predetermined first width through the substrate but not through the support member and forming openings through the substrate interiorly of the first and second ends, each opening being in communication with a distinct one of the first cuts. Second cuts are made in the substrate, each second cut extending from the second end of the substrate into communication with a distinct one of the openings. Marketing information is applied to the substrate between the first and second ends thereof. Individual marketing indicators are removed from the support member for use.

2 Claims, 2 Drawing Sheets

BELT MARKETING INDICATOR

CROSS-REFERENCE TO RELATED APPLICATION

This application is a continuation-in-part of Application Ser. No. 960,941, filed on Oct. 14, 1992, now Pat. No. 5,339,552, issued on Aug. 23, 1994, which is in turn a continuation-in-part of Application Ser. No. 817,750, filed on Jan. 7, 1992, now Pat. No. 5,334,274, issued on Aug. 2, 1994 Incorporating reference is made to both applications.

FIELD OF THE INVENTION

This invention relates generally to improved practices in garment manufacture and pertains more particularly to methods for use in belt making and belt-marketing indication assemblies and marketing indicators resulting from such methods.

BACKGROUND OF THE INVENTION

For purposes of indicating marketing parameters, e.g., belt manufacturer, price, size and the like, the conventional practice prior to the improvements set forth in the above-referenced patent applications was to use a so-called "swift tag" involving a plastic filament which is passed through an opening in a tag bearing the marketing parameters and through one of the prong receiving openings of the belt blank and then secured at filament ends to remain with the belt until the filament is cut apart at checkout.

The '750 patent application provides a method for use in belt making wherein a marketing indicator is secured with the belt at the time of the assembly of the belt blank and the belt buckle. More particularly, in making belts having buckles of the type having a prong pivotally supported by an arm of the buckle frame, following the step of applying a belt-retaining loop member to the belt blank and buckle disposed therewith, a portion of a marketing indicator is applied to the undersurface of the belt blank, interiorly of the boundary of the subsequent stitching, thereby to be secured with the stitched assembly.

When the stitching is performed, as is customary, in an inverted disposition of the belt blank, the '750 practice looks to retentive application of the marketing indicator to the undersurface of the belt blank. To this end, the portion of the indicator which is disposed interiorly of the stitching, or at least a part of such portion, has an adhesive backing applied thereto for securement thereof to the belt blank. Accordingly, upon inversion of the belt blank, the indicator remains with the belt blank, without assembler assistance.

In commercially implementing the '750 practice, applicants have provided the marketing indicators individually successively on a reel which is rotatably supported adjacent a belt assembler's work station, such that the assembler may take an individual indicator from the reel and apply the indicator to the belt blank.

In the '941 application, applicants addressed a problem occurring in the course of coiling belts with marketing indicators assembled therewith, namely, that the indicators tended to take curl set upon belt coiling and accordingly projected away from the belt upon vertical hanging thereof. The solution provided in the '941 application was to select a material for the indicator which did not take a curl set, whereby the indicator following belt uncoiling, remains flat against the belt.

SUMMARY OF THE INVENTION

The present invention has as its primary object improved practices in garment manufacture, particularly to improved methods for use in belt making.

Specific further objects of the invention are the providing of improved belt-marketing indication assemblies and marketing indicators.

In attaining the foregoing and other objects, the invention provides a method for use in making marketing indicators, each of a predetermined first width, the method comprising the steps of providing a substrate widthwise of a dimension which is at least a multiple of the predetermined first width and having opposed first and second ends, applying a support member to the substrate widthwise thereof at the first substrate end, making first cuts through the first substrate end at intervals of the predetermined first width through the substrate but not through the support member and forming openings through the substrate interiorly of the first and second ends, each opening being in communication with a distinct one of the first cuts. Second cuts are made in the substrate, each second cut extending from the second end of the substrate into communication with a distinct one of the openings. Marketing information is applied to the substrate between the first and second ends thereof. Individual marketing indicators are removed from the support member for use.

The foregoing and other objects and features of the invention will be further understood from the following detailed description of preferred embodiments thereof and from the drawings wherein like reference numerals identify like components throughout.

DETAILED DESCRIPTION OF PREFERRED EMBODIMENTS AND PRACTICES

Figure 1:
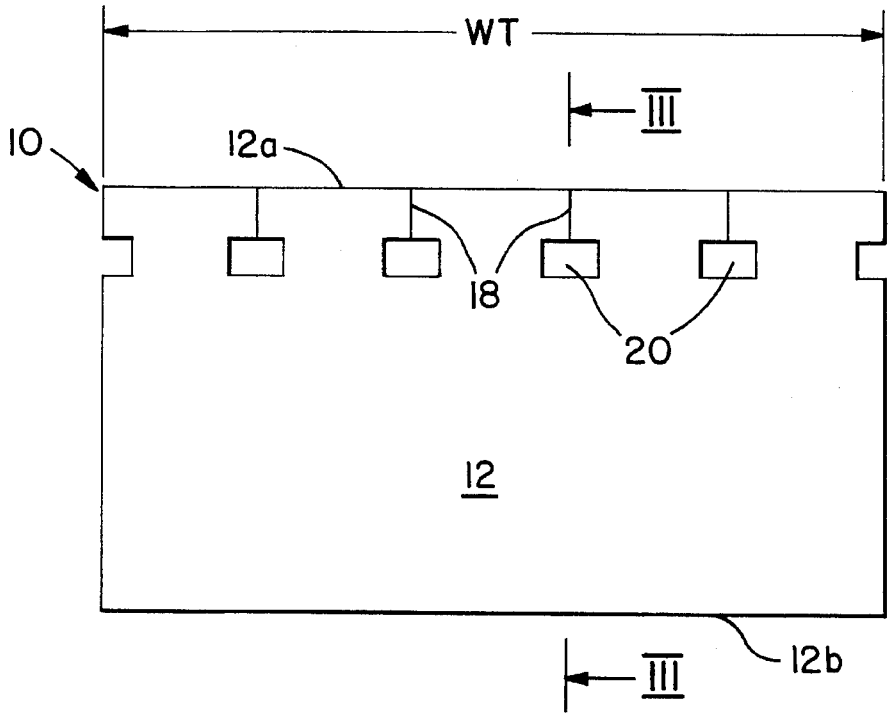
FIG. 1 is a plan view of a starting assembly for making a plurality of marketing indicators per the invention.
Figure 2:
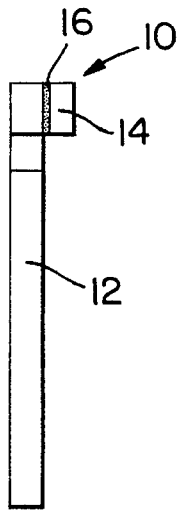
FIG. 2 is a right side elevation of FIG. 1.
Figure 6:
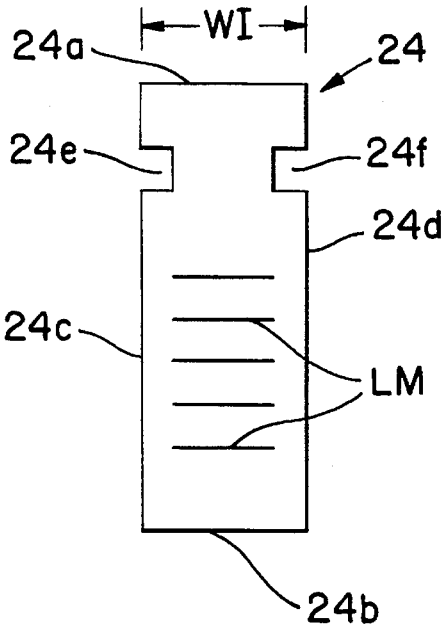
FIG. 6 is a plan view of an individual marketing indicator bearing imprinted marketing information.

Referring to FIGS. 1 and 2, starting assembly 10 includes substrate 12 which has a width WT, which is a multiple, e.g., five, of that of an individual marketing indicator width WI, shown in FIG. 6. The substrate is preferably constituted by an integral elongate sheet member of synthetic plastic material. Support member 14 extends continuously widthwise of substrate 12 and adhesive layer 16 releasably secures top end 12*a* of substrate 12 to support member 14.

Figure 3:
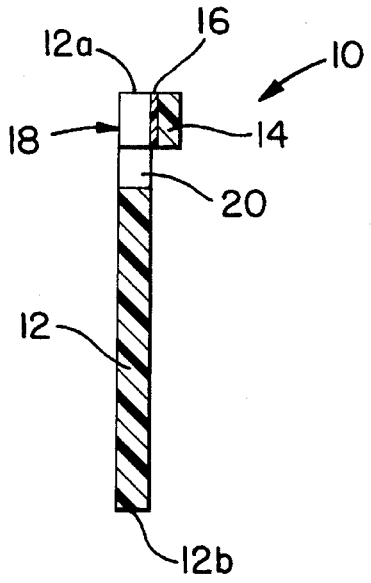
FIG. 3 is a sectional view of FIG. 1 as would be seen from plane III—III thereof.

First cuts 18 are made through substrate top end 12*a* at intervals of width WI through the substrate but not through support member 14. This condition is seen in FIG. 3, wherein support member 14 is seen as sectioned.

Openings 20, preferably of generally rectangular configuration are formed through substrate 12 interiorly of top end 12*a* and bottom end 12*b*. Each opening is in communication with a distinct one of first cuts 18.

Figure 4:
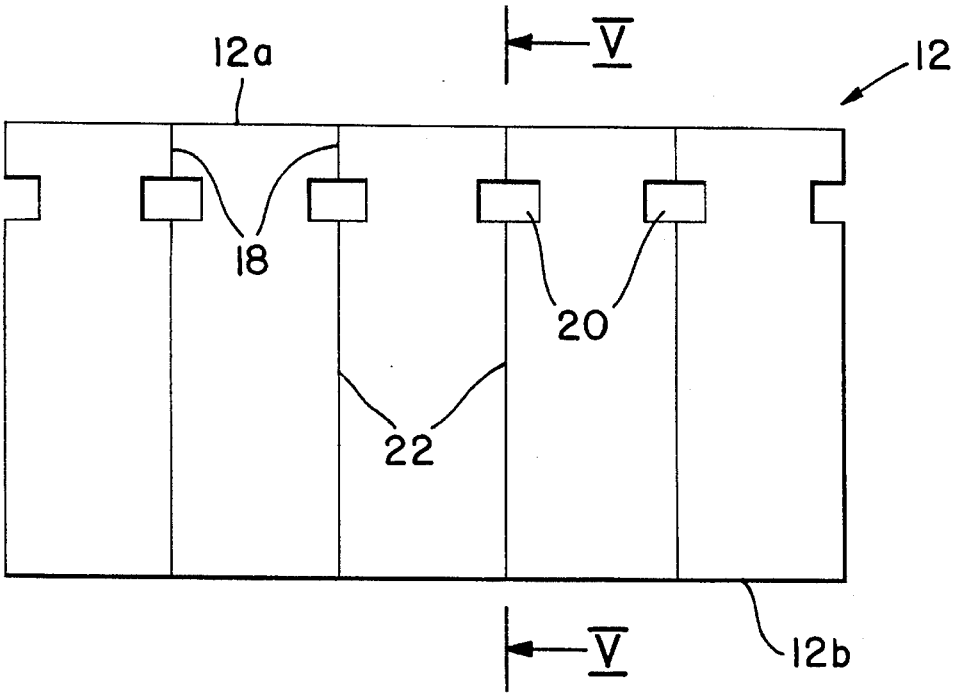
FIG. 4 is plan view of the FIG. 1 starting assembly upon further processing thereof.
Figure 5:
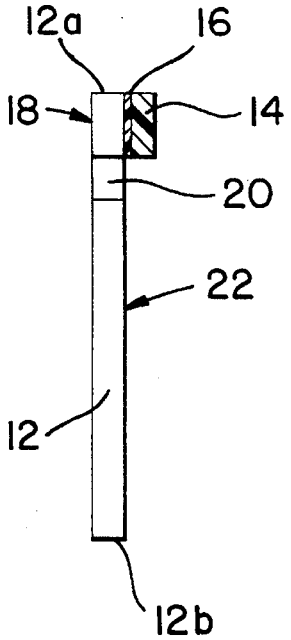
FIG. 5 is a sectional view of FIG. 4 as would be seen from plane V—V thereof.

Referring to FIG. 4, substrate 12 is shown further processed, by use of openings 20 for registering cutting apparatus, to include second cuts 22 through the substrate, each second cut extending from bottom end 12*b* of the substrate into communication with a distinct one of openings 20. The condition of substrate 12 at this juncture is seen in FIG. 5, a sectional view of FIG. 4.

Lastly, the substrate is imprinted with marketing information, again facilitated to be central between cuts 22 by use of openings 18, as is shown in FIG. 6, i.e., the marketing information being indicated by the vertical line sets LM occurring repetitively widthwise of the substrate. FIG. 6 is a plan view of an individual marketing indicator 24, the same having simply been peeled from support member 14 for use, e.g., in application to a belt as disclosed in the copending applications incorporated herein by the foregoing reference thereto.

The marketing indicator of FIG. 6 will be understood from the foregoing to be comprised of an integral elongate sheet member of synthetic plastic material having first and second longitudinally spaced ends 24*a* and 24*b*, with first and second margins 24*c* and 24*d* extending therebetween. First and second cutouts 24*e* and 24*f* are present, respectively in margins 24*c* and 24*d* equidistant from top end 24*a*, and the sheet member bears marketing information LM imprinted on a side thereof between the margins.

The assembly of FIGS. 1–3 will be seen as one facilitating the making of a plurality of marketing indicators each of a predetermined width, the assembly comprising a substrate having first and second end and a support member releasably secured to the substrate at the first end thereof, cuts at intervals of the predetermined width extending through the substrate at the first end thereof but not through the support member, the substrate having openings extending therethrough interiorly of the first and second ends thereof, each opening being in communication with a distinct one of the cuts.

Various changes in structure to the described marketing indicator assembly and practices connected therewith may evidently be introduced without departing from the invention. Accordingly, it is to be understood that the particularly disclosed and depicted embodiments and practices are intended in an illustrative and not in a limiting sense. The true spirit and scope of the invention is set forth in the following claims.

What is claimed is:

1. A marketing indicator comprised of an integral elongate sheet member of synthetic plastic material having first and second longitudinally spaced ends with first and second margins extending therebetween, first and second cuts respectively in said first and second margins equidistant from said first sheet member end, and marketing information imprinted on a side of said sheet member between said first and second margins and an adhesive layer disposed on a rear side of said sheet member, said adhesive layer extending with said sheet member from said first end thereof in non-overlapping relation to said first and second cuts.

2. The assembly claimed in claim 1 wherein said first and second cuts are of generally rectangular configuration.

* * * * *